US005540065A

United States Patent [19]

Wyers

[11] Patent Number: 5,540,065

[45] Date of Patent: Jul. 30, 1996

[54] LOCKING DEVICE

[76] Inventor: Philip W. Wyers, 6746 S. Ivy Ct., Englewood, Colo. 80111

[21] Appl. No.: 322,179

[22] Filed: Oct. 12, 1994

[51] Int. Cl.[6] ..... E05B 37/02

[52] U.S. Cl. ..... 70/26; 70/14; 70/34; 70/58; 70/312

[58] Field of Search ..... 70/14, 26, 34, 70/312, 315

[56] References Cited

U.S. PATENT DOCUMENTS

| | | | |
|---|---|---|---|
| 4,445,348 | 5/1984 | Saitoh | 70/312 |
| 4,524,592 | 6/1985 | Saitoh | 70/287 |
| 4,576,021 | 3/1986 | Holden | 70/34 |
| 4,615,191 | 10/1986 | Grandy | 70/26 |
| 4,844,498 | 7/1989 | Kerins et al. | 70/34 |
| 5,007,256 | 4/1991 | Lowe | 70/14 |

*Primary Examiner*—Steven N. Meyers
*Assistant Examiner*—Tuyet-Phuong Pham
*Attorney, Agent, or Firm*—Ancel W. Lewis, Jr.

[57] ABSTRACT

A locking device which may be used in locking one or more objects together, includes a rod having a key-like male portion at its tip and a combination locking means forming an enlarged head which locks over the rod's forward shackle. The locking head also includes a resettable combination inner assembly allowing for the setting of any combination by its user for convenient locking or removal without the need for additional tools or keys. The locking device further has on its exterior a series of outer projections allowing for its locking and unlocking without the benefit of visual confirmation.

10 Claims, 3 Drawing Sheets

LOCKING DEVICE

BACKGROUND OF THE INVENTION

The present invention relates to locking and security devices which may be used to secure one or more objects together. In applications requiring the use of the present invention, it is highly essential that the rod be securely locked against accidental or inadvertent removal or displacement, yet be readily removable when desired. General applications for a locking rod of the present invention would include the telescopic locking of trailer towing draw bars to their female vehicle-mounted receiver boxes, or to lock one object to another object such as the bow of a boat or jet ski to the bow ring of a trailer, or for securing attachments and accessories such as bicycle carriers into all types of vehicle-mounted receiver-type receptacles.

Prior proposals (see U.S. Pat. No. 4,711,106 and U.S. Pat. No. 4,428,211) offer types of locking devices designed for securing attachments and accessories to vehicles. These devices require the user to be burdened with carrying additional tools, such as a key, in order to remove the locking device. The prior proposals fail to provide the user with a simple, reliable, and convenient way of removing the locking device without also having a specialized tool or key to facilitate its removal. The prior proposals' drawbacks become apparent in practical applications such as their use on construction vehicles used by numerous employees and that may be required to pull a multitude of different equipment, which may each require a different hitch tongue and ball assembly. Under this scenario, the requirement of having a specialized tool or key carried by each employee becomes increasingly burdensome, or without multiple keys, greatly increases the risk of a single key being lost at a muddy construction site or being broken off in the lock device itself. Further, the requirement of a specialized tool or key requires the physical transportation of that specialized tool or key to specific locations versus the convenience of verbal communication of a combination locking number via telephone, facsimile, or an electronic pager. In recreational applications such as boating or water sports wherein multiple family members and/or friends may use or borrow a certain water craft, the same logistic problems of requiring a specialized tool or key would exist. Further amplifying the inconvenience of carrying a specialized tool or key to lock or unlock a given piece of equipment, is that the types of clothing being worn, such as swimming suits, are often not equipped with reliable area for securely stowing a specialized tool or key. The fact that these vehicles are operated in water of substantial depth greatly increases the opportunity of permanent loss of the specialized tool or key should it be accidentally dropped. Further, these prior proposals fail to provide a locking device that is simple in construction, inexpensive to manufacture, highly effective in operation, and sleek in appearance. While still other known prior art make attempts at utilizing combination locking devices (see U.S. Pat. No. 4,445,348), they fail to provide the user with the structual rigidity needed to serve effectively as a cross bolt, or shear pin locking device. Prior proposals further fail to provide structurally sound means permitting the ready change of the lock combination to one easy for the user to remember. The invention eliminates these and other drawbacks of the prior art.

SUMMARY OF THE INVENTION

It is an object of the invention to provide a locking device capable of being used to lock one or more objects together without the need for additional specialized tools or keys.

Another object of the invention is to provide a locking device which utilizes a combination locking means which can be locked or unlocked without the benefit of any type of light in which to see the numbers on the combination wheels.

Yet another object of the invention is to provide a hitch pin lock featuring an easily resettable combination locking means which permits the ready disassembly and removal of the combination wheels for resetting of the combination to one that is easy to recall by the user.

A further object of the invention is to provide a locking pin of the above type that is simple in construction, inexpensive to manufacture, highly effective in operation, and pleasant in appearance.

Yet another object of the invention is to provide an easy-to-use locking hitch pin for connecting a draw bar into a receiver box mounted to a vehicle.

Still another object of the invention is to provide a multi-purpose locking device capable of being used to lock the bow portion of a watercraft to a trailer.

Briefly, the foregoing objects are accomplished by the present invention which comprises an elongated rod having at one end a stop provided by a deformation so as to prevent the entire rod from passing through an aperture of slightly greater diameter than the rod, and further having at its forward tip, a key-like male portion affixed in a central bore by a substantially perpendicular press pin passing through both the key-like shackle and forward rod tip, which is telescopically mated with a barrel-type combination lock having a collar portion overlapping the forward tip of said rod so as to prevent any inadvertent removal or tampering of perpendicular said pin, and wherein the rotation of one or more of the combination lock wheels, which rotate about the lock shaft body, cause the engagement of internal clutches to effect the locking of the relatively large combination locking head to the key-like shackle which is affixed to the forward portion of said rod. The preferred embodiment of the present invention employs the oversized locking head mentioned above, made up of a barrel-type combination lock containing a plurality of combination wheels that can be readily changed with the removal of the specially designed cone-shaped collar, and sliding the permutation wheels off the internal clutches and placing them in different radial positions to create a multitude of combinations easy for the user to remember. The specially designed cone-shaped collar, which flairs outward in a direction toward the rod in a mushrooming fashion, has on its exterior a spline to be utilized for the non-visual alignment of the combination wheels and still further having on its expanded face a bore of a diameter great enough to accept the forward portion of said rod in a telescopic fashion so as to overlap the perpendicular set pin, which secures the key-like shackle tip into the central bore of the forward portion of said rod. The combination wheels which are mounted on the lock body have individual projections creating thumb index tabs to facilitate non-visual lock operation. The cone-shaped locking collar with its overlapping effect created by the telescopic engagement with said rod create an unforeseen strength and redundant safety features.

In a modification of the invention, the locking head is formed by any number of rounded or rectangular-shaped combination locking heads which provide internal means that utilize combination wheels for locking to a a rod or shaft. These and further objects, features and advantages of the present invention will become more obvious from the following description when taken in connection with the accompany drawings which show, for purposes of illustration only, several embodiments in accordance with the present invention.

DESCRIPTION OF THE PREFERRED EMBODIMENT

Figure 1:
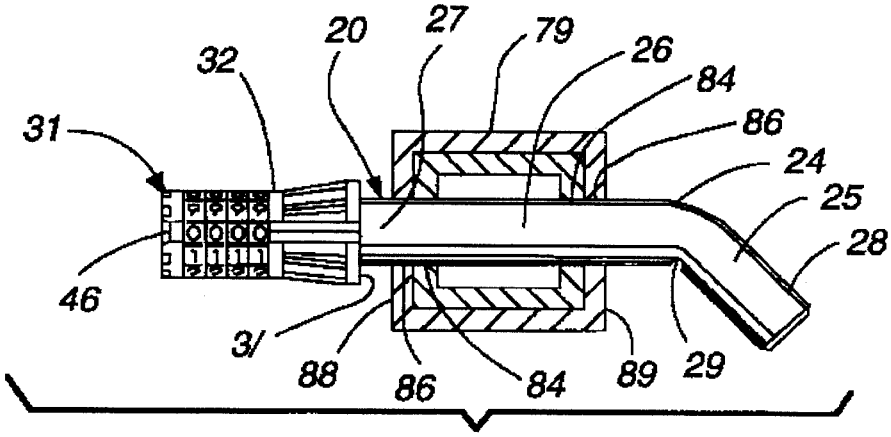
FIG. 1 illustrates the preferred embodiment and is a side view of the locking device according to the present invention, shown illustratively inserted into the aligned apertures of two interlocking hitching members which are shown in cross section.
Figure 2:
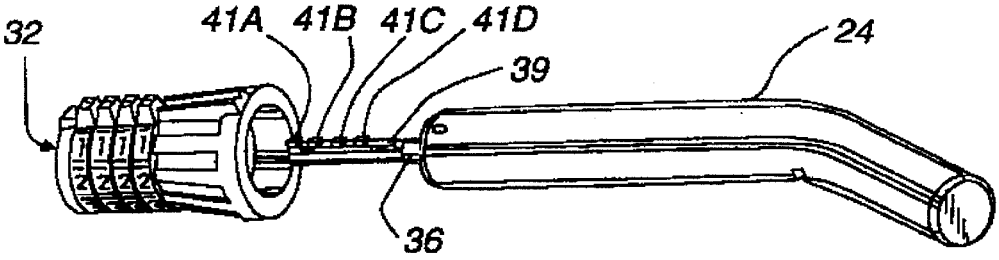
FIG. 2 is a perspective view of the locking hitch pin in FIG. 1, with the rod and locking head detached from each other.
Figure 3:
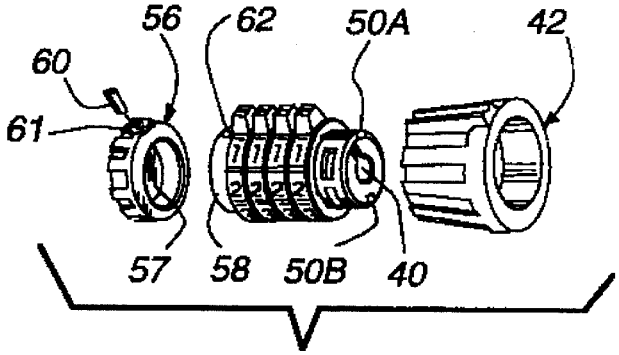
FIG. 3 shows a perspective view of the locking head assembly and its key components.
Figure 4:
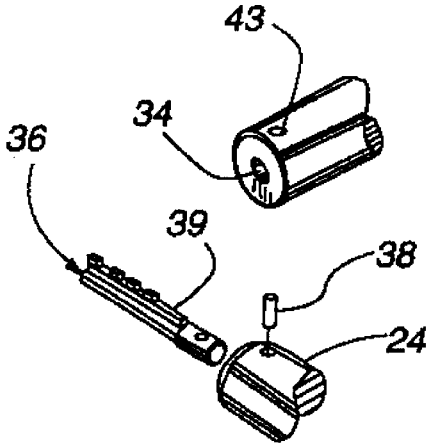
FIG. 4 shows an exploded assembly perspective view of the rod tip and shackle portion.
Figure 5:
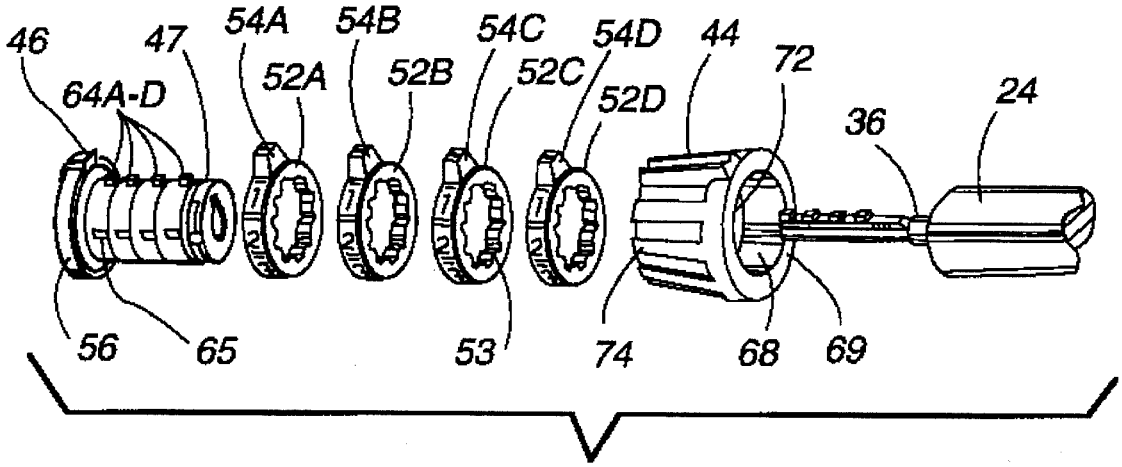
FIG. 5 shows a further exploded perspective view of FIG. 3 wherein the internal clutches of the lock head assembly are made apparent.

Referring more particularly to the drawings wherein like numbers refer to like parts, FIG. 1. shows a locking device 20, including a connecting rod 24 having a first end portion 25 a straight portion 26 and a second end portion 27. The rod 24 has first stop 29 provided by forming a bend in the second end portion. A locking head assembly 32 shown generally in FIG. 2. The end of head 32 forms a stop 31 to prevent removal of the rod from the hitch. FIG. 1 shows locking head 32 locked over the forward male portion in form of a shackle tip 36 of the rod 24, and FIG. 2 shows the locking head 32 separated from the forward shackle portion 36 of the rod 24. The forward shackle portion 36 of the rod 24 having a spline 39 with teeth 41*a*, 41*b*, 41*c*, and 41*d* combine to form the key-shaped shackle 36 as shown in FIGS. 2, 4, and 5. Forward end of rod 24 as shown in FIG. 4 having a smooth axial bore 34 for insertion of shackle 36 and held in position by a lock pin 38 pressed through a perpendicular pin-receiving hole 43 at the forward portion of rod 24. The locking head 32 includes a collar 42, a lock shaft body having an axial key bore 40. The lock shaft body 48 further having two collar locking grooves 50*a* and 50*b* as shown in FIG. 3 for attaching and detaching collar 42 for the removal and installation of combination wheels 52*a*, 52*b*, 52*c*, and 52*d* as shown in expanded form in FIG. 5. Combination wheels 52*a*, 52*b*, 52*c*, and 52*d* are prevented from sliding off the rearward portion of lock shaft body 48 by end cap 56 having a cavity bore 57 for telescopically mating over the rearward portion of lock shaft body 48 and held in position by an end cap lock pin 60 pressed through a receiving hole 61 in end cap 56 and into receiving hole 62 of lock shaft body 48.

Figure 6:
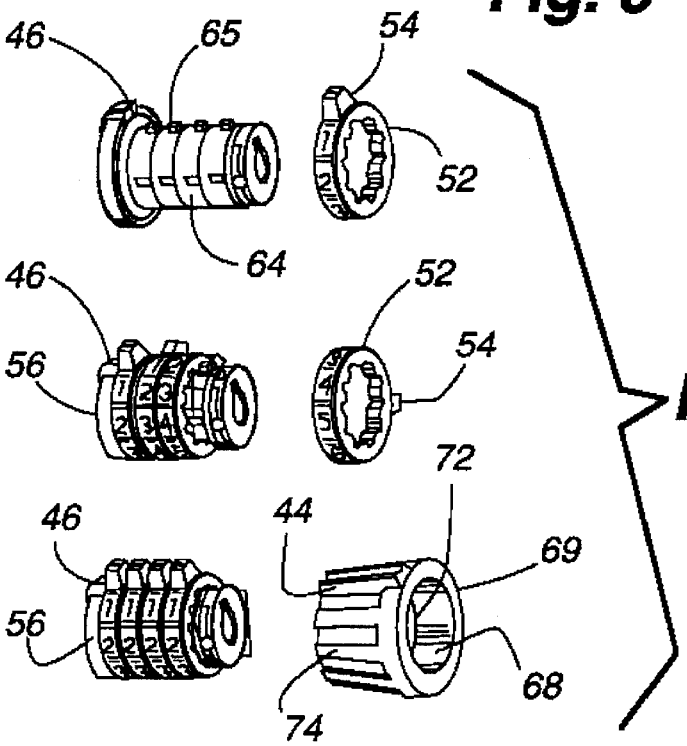
FIG. 6 is an illustrative perspective view of lock head detailing the progressive assembly of the locking head in various combination formats.

As shown in FIGS. 5 and 6 the lock shaft body 48 contains four clutch wheels 64*a*, 64*b*, 64*c* and 64*d* which are held permanently in place by the slightly expanded head portion 47 located at the forward end of lock shaft body 48. Clutch wheels 64*a–d* are prevented from being removed form the rearward portion of lock shaft body 48 by end cap 56 as shown in FIG. 5.

With particular reference to FIG. 5, clutches 64*a–d* have projections 65 which are engageable with the plurality of combination wheels 52*a–d* which have complementary internal recesses on each wheel. Combination wheels 52*a–d* also carry thumb pieces 54*a–d* to assist in non-visual determination of combination wheel position. Lock collar 42 has projecting from its outer cone-shaped surface a spline 44 running its full length which serves as a guide, together with end cap 56 and end cap spline 46, serve as a guide for visual or non-visual alignment of combination wheels 52*a–d* in the locking and unlocking of locking head 32 to rod 24. Further note that collar 42 has on its cone-shaped exterior ribs 74 which aid in gripping the locking head 32 for rotation of combination wheels 42*a–d*. Further note that collar 42 contains an internal bore which forms a shroud 68 which encircles the forward portion of rod 24 adding lateral strength and preventing the accidental release of shackle lock pin 38 which would cause the release of the shackle tip 36 from rod 24.

Figure 7:
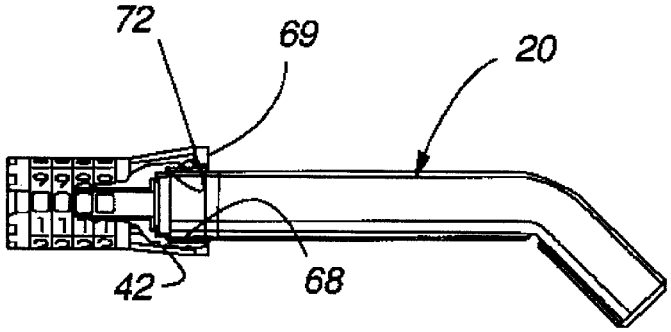
FIG. 7 shows a cutaway view according to the present invention in FIG. 1 detailing the internal relationships of the collar portion of the locking head with the rod and shackle.

FIG. 7 illustrates a cutaway view of the preferred embodiment 20 further illustrating shroud 68 of collar 42. Shroud has a shroud face 69. FIGS. 5 and 7 also show an internal shoulder 72 of collar 42 which serves to prevent the removal of collar 42 form lock shaft body 48 when locking head 32 is telescopically mated with rod 24 and placed in the lock position.

FIG. 6 illustrates the ease in which the combination wheels 52*a–d* can be removed from the lock shaft body 48 after removal of collar 42 of locking head 32 and then translated back over clutches 64*a–d* with their respective projections 65 to provide any convenient combination desired.

In referring back to FIG. 1, the embodiment 20 is shown in the form of a trailer hitch locking device intended for telescopically locking two or more pieces of equipment or objects together, such as a trailer hitch draw bar into a female receiver box. In FIG. 1 the central draw bar 78, having apertures 84 into female receiver box 79, also having apertures 86, as jointed telescopically by the insertion of the draw bar 78 into the receiver box 79 so that the apertures 84 and 86 are properly aligned in a matching configuration as shown in FIG. 1. The rod 24 may then be inserted into the apertures 86 and 84 so that the shackle portion 36 extends outwardly on side 88 of receiver box 79, which is opposite side 89 of receiver box 79 where rod 24 is restricted from passing completely through aperture 86 by the bend point 29 which creates rod elbow 28. Rod 24 is securely locked in position by the user telescopically placing the locking head 32 over the outwardly projecting shackle 36 from rod 24. The user may then permanently affix the locking head 32 to rod 24 by the simple rotation of one or more combination wheels 52*a–d*. Lock head 32 may then be removed by dialing combination wheels 52*a–d* to the unlock combination setting. Each wheel 52 has an internal combination wheel guide 53. Lock head 32 may also be removed non-visually in a night-time situation by user locating the collar spline 44 and end cap spline 46, then centering the thumb pieces 54 of all combination wheels 52*a–d* in direct parallel alignment with splines 44 and 46 and then simply systematically rotating the combination wheel 52 thumb piece 54 in a clockwise direction counting the clicks until the desired number arrives in alignment with splines 46 and 44. This process would be repeated for all combination wheels 52*a–d* until the unlocked combination is derived and lock head 32 can be easily removed from rod 24, which would allow the withdrawal of rod 24 from receiver box 79.

Figure 8:
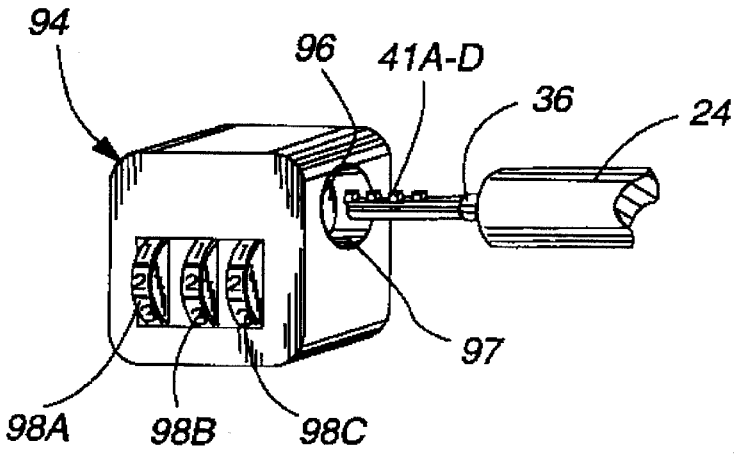
FIG. 8 illustrates a further modification of the invention.

In a modification shown in FIG. 8 the locking head 94 is formed in a rectangular fashion having a key bore 96 for telescopically receiving the shackle 36 of rod 24. Locking head 94 can be locked to rod 24 by the simple rotation of encased combination wheels 98*a*, 98*b*, and 98*c*. Locking head 94 has a shroud 97 around the shackle 36.

It should be understood that various changes and modifications of the embodiment shown in the drawings may be made within the scope of this invention. Thus, is it intended that all matter contained in the above description or shown in the accompanying drawings shall be interpreted in an illustrative and not limiting sense.

Although the invention is shown and described herein with regard to draw bar locks, it will be understood that it may be employed on any type of bolt, yolk pin, clevice pin, connecting rod, linkage, or elongated shank that must be lock in an aperture.

Figure 9:
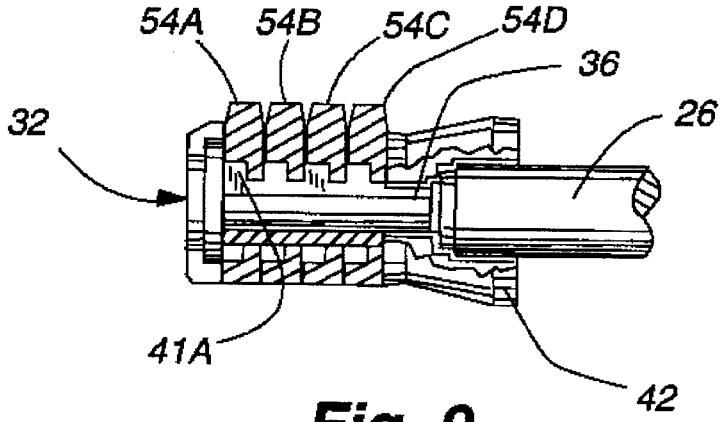
FIG. 9 shows a cross section of the lock head in the lock position.
Figure 10:
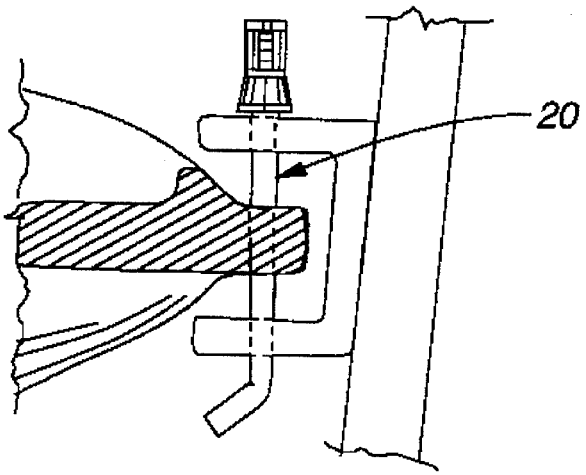
FIG. 10 further shows the locking device in use in locking the bow of a watercraft to a trailer.

FIG. 9 shows a cross section of the lock head 32 in the lock position. FIG. 10 further shows the locking device 20 in use in locking the bow of a watercraft to a trailer.

What is claimed is:

1. A locking device comprising:

an elongated hitch rod for connecting a trailer-type hitch having a towing member and a towed member with each of said members having an aperture, said hitch rod being in the form of a rigid body of substantially uniform diameter between a first end and a second end, said rod having a first end portion, an intermediate portion and a second end portion, with said rod being sized to slide through the apertures said in said members, said rod having a deformation at said first end portion to form a stop to hold said rod against movement all the way through said members, a barrel-shaped cylinder-type combination lock not requiring a key for locking and unlocking, said lock having a head with a collar having an internal bore, said collar telescopically receiving in a telescopic overlapping relation a portion of said second end portion and having an internal shoulder against which said second end portion abuts to limit the extent of telescoping insertion of said second end portion into said collar, said head having a shaft body with a head portion and a cylindrical core portion formed with a key bore, an end cap portion having on an outer surface a spline and being secured to said shaft body, a plurality of inner clutch rings, each of said inner clutch rings having a slot in an inner circumference and at least one protrusion on an outer circumference, said inner clutch rings being mounted on said shaft body to provide for rotation of said inner clutch rings on said shaft body, said inner clutch rings being mounted rotatably to a position where slots thereof are in groove alignment with said key bore to form a key groove, said inner clutch rings being slightly positioned over said shaft body and abutting said collar and held in place by said end cap and a press pin, combination wheels on said shaft body of the same number as said inner clutch rings, each of said combination wheels having a plurality of indicia on an outer circumference, said combination wheels being mounted on said inner clutch rings, said second mounting means including at least one notch on said dial ring for accommodating a protrusion on said inner clutch ring, such that said dial ring may be mounted on inner clutch ring at any desired relative angular position, said collar being cone-shaped having a smaller key-shaped bore hole for axially aligning with said key bore hole of said shaft body, said collar having at a narrow end a cavity containing lock tangs for the engagement with the expanded head portion of said shaft body, said hitch rod having a male portion affixed to and projecting beyond said second end portion, said male portion including a straight shaft portion having a shackle with key-like projections, said shackle being inserted into a centrally located bore in said rod and held by a pin, said collar overlapping said pin to prevent removal of said pin when locked on said rod, whereby upon an insertion of a forward key-like shackle into said key bore a rotation of one or more of said outer combination wheels combines both head and rod, and whereby setting said combination wheels to an open position allows a removal of said rod to permit changing a rotational position of each combination wheel relative to its respective inner clutch ring to thereby change a combination on said lock.

2. A device as set forth in claim 1 wherein said stop is provided by a deformation forming an elbow.

3. A device as set forth in claim 1 wherein said collar is removable from said shaft body.

4. A device as set forth in claim 1 wherein said collar has a spline which serves as a guide for a numeric alignment of said combination wheels.

5. A device as set forth in claim 1 wherein said head has an end cap portion contains a spline used in aligning a plurality of numeric combination wheels in a common plane with a spline on said collar.

6. A device as set forth in claim 1 wherein said head has a rectangular shape.

7. A device as set forth in claim 1 wherein said head has means for causing said head to lock by rotating one or more of a plurality of said combination wheels.

8. In combination, a combination locking assembly and hitch rod device and a trailer-type hitch comprising:

a hitch towing member having an aperture, a hitch towed member having an aperture, an elongated hitch rod connecting said towing member to said towed member, said hitch rod being in the form of a rigid body of substantially uniform diameter between a first end and a second end, said rod having a first end portion, an intermediate portion and a second end portion with said rod being sized to slide through said apertures in said members, said second end portion having a stop to hold said rod against movement all the way through said members, a barrel-shaped cylinder-type combination lock not requiring a key for locking and unlocking, said lock having a head with a collar having an internal bore, said collar telescopically receiving in a telescopic overlapping relation a portion of said second end portion and having an internal shoulder against which said second end portion abuts to limit the extent of telescoping insertion of said second end portion into said collar, said head having a shaft body with a head portion and a cylindrical core portion formed with a key bore, an end cap portion having on an outer surface a spline and being secured to said shaft body, a plurality of inner clutch rings, each of said inner clutch rings having a slot in an inner circumference and at least one protrusion on an outer circumference, said inner clutch rings being mounted on said shaft body to provide for rotation of said inner clutch rings on said shaft body, said inner clutch rings being mounted rotatably to a position where slots thereof are in groove alignment with said key bore to form a key groove, said inner clutch rings being slightly positioned over said shaft body and abutting said collar and held in place by said end cap and a press pin, combination wheels on said shaft body of the same number as said inner clutch rings, each of said combination wheels having a plurality of indicia on an outer circumference, said combination wheels being mounted on said inner clutch rings, said second mounting means including at least one notch on said dial ring for accommodating a protrusion on said inner clutch ring, such that said dial ring may be mounted on inner clutch ring at any desired relative angular position, said collar being cone-shaped having a smaller key-shaped bore hole for axially aligning with said key bore hole of said shaft body, said collar having at a narrow end a cavity containing lock tangs for the engagement with the expanded head portion of said shaft body, said hitch rod having a male portion affixed to and projecting beyond said second end portion, said male portion including a straight shaft portion having a shackle with key-like projections, said shackle being inserted into a centrally located bore in said rod and held by a pin, said collar overlapping said pin to prevent removal of said pin when locked on said rod, whereby upon an insertion of a forward key-like shackle into said key bore a rotation of one or more of said outer combination wheels combines both head and rod, and whereby setting said combination wheels to an open position allows a removal of said rod to permit changing a rotational position of each combination wheel relative to its respective inner clutch ring to thereby change a combination on said lock.

9. A device as set forth in claim 8 wherein said hitch towing member is a towing drawbar and said hitch towed member is a receiver hitch that telescopes in said towing bar and releasably attaches to a towing vehicle.

10. A device as set forth in claim 8 wherein said hitch towing member is a c-shaped hitch and said hitch towed member is a towed vehicle.

* * * * *